United States Patent [19]

Wesselhoft et al.

[11] 4,292,048

[45] Sep. 29, 1981

[54] INTEGRATED CATALYTIC COAL DEVOLATILIZATION AND STEAM GASIFICATION PROCESS

[75] Inventors: Robert D. Wesselhoft, Baytown; Daniel F. Ryan, Friendswood, both of Tex.

[73] Assignee: Exxon Research & Engineering Co., Florham Park, N.J.

[21] Appl. No.: 106,123

[22] Filed: Dec. 21, 1979

[51] Int. Cl.[3] ..... C10J 3/54

[52] U.S. Cl. ..... 48/197 R; 48/202; 48/210; 208/10

[58] Field of Search ..... 48/197 R, 202, 206, 48/210; 208/10; 252/373; 260/449 M

[56] References Cited

U.S. PATENT DOCUMENTS

| | | | |
|---|---|---|---|
| 2,687,950 | 8/1954 | Kalbach | 48/206 |
| 2,694,623 | 11/1954 | Welty et al. | 48/197 R |
| 3,004,839 | 10/1961 | Tornquist | 48/197 R |
| 3,929,431 | 12/1975 | Koh et al. | 48/202 |
| 3,958,957 | 5/1976 | Koh et al. | 48/197 R |
| 3,985,519 | 10/1976 | Kalina et al. | 48/202 |
| 4,094,650 | 6/1978 | Koh et al. | 48/197 R |
| 4,118,204 | 10/1978 | Eakman et al. | 48/197 R |

OTHER PUBLICATIONS

New Coal Gasifier to be Tested, Coal Age, Dec. 1977, pp. 145–151.

*Primary Examiner*—Peter F. Kratz
*Attorney, Agent, or Firm*—Yale S. Finkle

[57] ABSTRACT

Hydrocarbon liquids and a methane-containing gas are produced from carbonaceous feed solids by contacting the solids with a mixture of gases containing carbon monoxide and hydrogen in a devolatilization zone at a relatively low temperature in the presence of a carbon-alkali metal catalyst. The devolatilization zone effluent is treated to condense out hydrocarbon liquids and at least a portion of the remaining methane-rich gas is steam reformed to produce the carbon monoxide and hydrogen with which the carbonaceous feed solids are contacted in the devolatilization zone. The char produced in the devolatilization zone is reacted with steam in a gasification zone under gasification conditions in the presence of a carbon-alkali metal catalyst and the resultant raw product gas is treated to recover a methane-containing gas.

11 Claims, 1 Drawing Figure

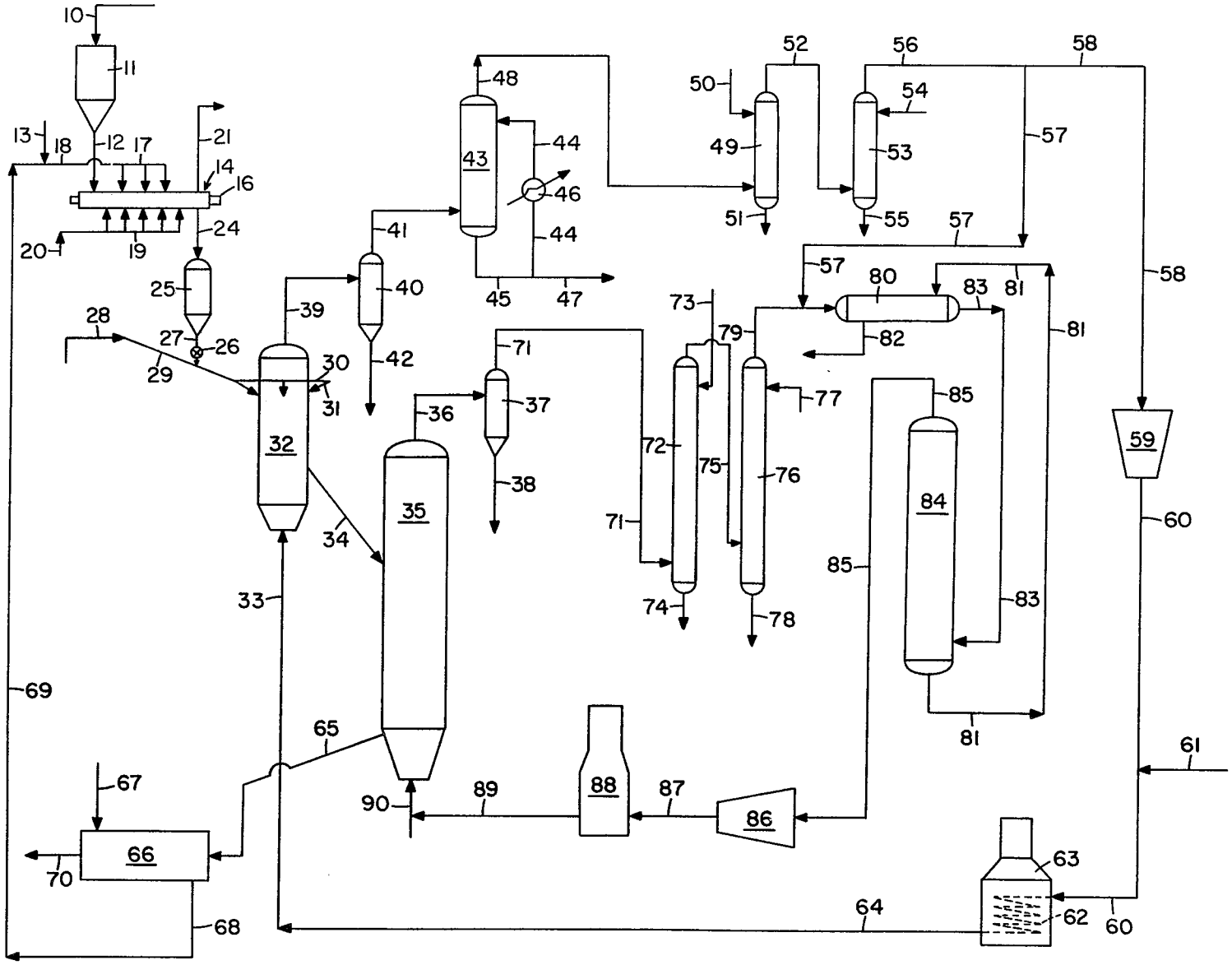

INTEGRATED CATALYTIC COAL DEVOLATILIZATION AND STEAM GASIFICATION PROCESS

BACKGROUND OF THE INVENTION

This invention relates to the devolatilization and gasification of coal and similar carbonaceous materials and is particularly concerned with an integrated catalytic devolatilization and steam gasification process carried out in the presence of a carbon-alkali metal catalyst to simultaneously produce both a methane-containing gas and hydrocarbon liquids.

Existing and proposed processes for the manufacture of synthetic gaseous fuels from coal or similar carbonaceous materials normally require the reaction of carbon with steam, alone or in combination with oxygen, at temperatures between about 1200° F. and about 2500° F. to produce a gas which may contain some methane but consists primarily of hydrogen and carbon monoxide. This gas can be used directly as a synthesis gas or a fuel gas with little added processing or can be reacted with additional steam to increase the hydrogen-to-carbon monoxide ratio and then fed to a catalytic methanation unit for reaction with carbon monoxide and hydrogen to produce methane. It has been shown that processes of this type can be improved by carrying out the initial gasification step in the presence of a catalyst containing an alkali metal constituent. The alkali metal constituent accelerates the steam-carbon gasification reaction and thus permits the generation of synthesis gas at somewhat lower temperatures than would otherwise be required. Processes of this type are costly because of the large quantities of heat that must be supplied to sustain the highly endothermic steam-carbon reaction. One method of supplying this heat is to inject oxygen directly into the gasifier and burn a portion of the carbon in the feed material being gasified. This method is highly expensive in that it requires the existence of a plant to manufacture the oxygen. Other methods for supplying the heat have been suggested, but these, like that of injecting oxygen, are expensive.

It has been recently found that difficulties associated with processes of the type described above, can largely be avoided by carrying out the reaction of steam with carbon in the presence of a carbon-alkali metal catalyst and substantially equilibrium quantities of added hydrogen and carbon monoxide. Laboratory work and pilot plant tests have shown that catalysts produced by the reaction of carbon and alkali metal compounds such as potassium carbonate to form carbon-alkali metal compounds or complexes will, under the proper reaction conditions, equilibrate the gas phase reactions occurring during gasification to produce methane and at the same time supply substantial amounts of exothermic heat within the gasifier. This additional exothermic heat of reaction essentially balances the overall endothermicity of the reactions involving solid carbon and thus results in a substantially thermoneutral process in which the injection of large amounts of oxygen or the use of other expensive methods of supplying heat are eliminated.

The catalytic effect of carbon-alkali metal catalysts on the gas phase reactions, as distinguished from the solid-gas reactions or the reactions of carbon with steam, hydrogen or carbon dioxide, allows the following exothermic reactions to contribute substantially to the presence of methane in the effluent gas and drastically reduces the endothermicity of the overall reaction:

$$2CO+3H_2 \rightarrow CO_2+CH_4 \text{ (exothermic)} \quad (1)$$

$$CO+3H_2 \rightarrow H_2O+CH_4 \text{ (exothermic)} \quad (2)$$

$$CO_2+4H_2 \rightarrow 2H_2O+CH_4 \text{ (exothermic)} \quad (3)$$

Under the proper operating conditions, these reactions can be made to take place within the gasification zone and supply large amounts of methane and additional exothermic heat which would otherwise have to be supplied by the injection of oxygen or other means. Laboratory and pilot plant tests have shown that constituents of the raw product gas thus produced are present in equilibrium concentrations at reaction conditions and consist primarily of hydrogen, carbon monoxide, carbon dioxide, methane and steam. It has been proposed to utilize steam gasification in the presence of a carbon-alkali metal catalyst to produce a high Btu product gas by treating the raw product gas for removal of steam and acid gases, principally carbon dioxide and hydrogen sulfide; cryogenically separating carbon monoxide and hydrogen in amounts equivalent to their equilibrium concentration in the raw product gas from the methane in the treated gas; withdrawing methane as a high Btu product gas; and recycling the carbon monoxide and hydrogen to the gasifier. The presence in the gasifier of the carbon-alkali metal catalyst and equilibrium quantities of recycle carbon monoxide and hydrogen, which tend to suppress reactions that would otherwise produce additional hydrogen and carbon monoxide, results in a substantially thermoneutral reaction to produce essentially methane and carbon dioxide. Since the overall reaction is substantially thermoneutral, only a small heat input is required to preheat the carbonaceous feed material and to maintain the reactants at reaction temperatures by compensating for heat losses from the gasifier. This small amount of heat may be supplied by preheating the gaseous reactants in a conventional preheat furnace.

It has also been proposed to utilize steam gasification of a carbonaceous feed material in the presence of a carbon-alkali metal catalyst to produce an intermediate Btu product gas by treating the raw product gas withdrawn from the gasifier for the removal of steam and acid gases, principally carbon dioxide and hydrogen sulfide; recovering a portion of the treated gas as the intermediate Btu product gas; contacting the remainder of the treated gas with steam in a steam reformer under conditions such that the methane in the treated gas reacts with the steam to produce additional hydrogen and carbon monoxide; and passing the effluent from the reformer into the gasifier. The amounts of hydrogen and carbon monoxide produced in the reformer compensate for the amounts of those gases removed in the treated gas that is withdrawn as intermediate Btu product gas. Thus the reformer effluent will normally contain carbon monoxide and hydrogen in amounts equivalent to the equilibrium quantities of those gases present in the raw product gas and will therefore supply the substantially equilibrium quantities of hydrogen and carbon monoxide required in the gasifier along with the carbon-alkali metal catalyst and steam to produce the thermoneutral reaction that results in the formation of essentially methane and carbon dioxide.

Although the above-described catalytic gasification processes result in the substantially thermoneutral reaction of steam with carbon to form a raw product gas containing equilibrium quantities of carbon monoxide, carbon dioxide, hydrogen, steam, and methane by recycling carbon monoxide and hydrogen in quantities equivalent to their concentration in the raw product gas to the gasifier and are therefore significant improvements over previously proposed noncatalytic and catalytic processes, they have one major disadvantage. Neither process can be operated in a manner to produce hydrocarbon liquids concurrently with the methane-containing gaseous product. A product mix of both liquids and gases may be highly desirable depending upon the markets available for gases and liquids at any particular time and the prevailing prices for both types of fuels.

SUMMARY OF THE INVENTION

The present invention provides a catalytic process which at least in part overcomes the disadvantage described above. In accordance with the invention, it has now been found that high-quality, hydrocarbon liquids can be produced simultaneously with a methane-containing gas from a solid carbonaceous feed material by integrating a catalytic devolatilization zone with a catalytic steam gasification zone. The carbonaceous feed solids are introduced into the devolatilization zone and contacted in the presence of a carbon-alkali metal catalyst with a mixture of gases containing carbon monoxide and hydrogen at a temperature sufficiently high to devolatilize the carbonaceous feed solids but sufficiently low to prevent any substantial reaction of steam with the carbonaceous solids. During the devolatilization step char is produced along with a methane-rich, devolatilization effluent containing gaseous and vaporous constituents. The devolatilization zone effluent is treated to recover hydrocarbon liquids as product and at least a portion of the remaining methane-rich gas is contacted with steam in a steam reforming zone under conditions such that at least a portion of the methane in the methane-rich gas reacts with steam to produce hydrogen and carbon monoxide. The reforming zone effluent is then used as the mixture of gases with which the carbonaceous feed solids are contacted in the devolatilization zone. The char produced in the devolatilization zone is passed to a gasification zone where it is reacted with steam under gasification conditions in the presence of a carbon-alkali metal catalyst and sufficient added hydrogen and carbon monoxide to provide substantially equilibrium quantities of hydrogen and carbon monoxide in said gasification zone at the gasification temperature and pressure. A methane-containing raw product gas, containing substantially equilibrium quantities, at the gasification temperature and pressure, of methane, carbon dioxide, steam, hydrogen and carbon monoxide is then withdrawn from the gasification zone and can be processed to recover a methane-containing gas ranging in quality from pure methane to an intermediate Btu gas comprising a mixture of methane, carbon monoxide and hydrogen. If methane is the desired product, the raw product gas is treated to remove steam and carbon dioxide and the carbon monoxide and hydrogen in the treated gas is removed from the product methane and recycled to the gasification zone where it serves as the added hydrogen and carbon monoxide required in the zone. If an intermediate Btu gas is desired, the raw product gas is treated to remove steam and carbon dioxide and the resulting mixture of methane, carbon monoxide and hydrogen is recovered as product. The hydrogen and carbon monoxide required in the gasification zone is supplied by passing a greater amount of the methane-rich gas recovered from the devolatilization zone effluent through the reformer and using a portion of the reformer effluent as the source for the required hydrogen and carbon monoxide.

The devolatilization zone is operated at a relatively low temperature compared to the operating temperature of the gasification zone and therefore equilibrium in the devolatilization zone will strongly favor methane production via the reaction of the carbon monoxide with the hydrogen in the mixture of gases introduced into the zone. The carbon-alkali metal catalyst present in the devolatilization zone enables this exothermic methanation reaction to proceed at a reasonable rate even though the temperature in the zone is relatively low. The heat liberated by the reaction of the carbon monoxide and hydrogen to form methane and the sensible heat in the reforming zone effluent supplies substantially all of the heat required to effect the devolatilization of the carbonaceous feed solids and no other heat input, such as the direct injection of oxygen to burn a portion of the carbon in the feed solids, is normally required. The temperature in the devolatilization zone is maintained sufficiently high to devolatilize the carbonaceous feed solids thereby driving off gaseous hydrocarbons including methane in addition to vaporizing normally liquid hydrocarbons which are condensed and recovered as the liquid product. The hydrocarbon liquids produced by devolatilization in the presence of the carbon-alkali metal catalyst are particularly desirable because they will be substantially free of tars, will have a low oxygen content, a high Btu content and will be relatively stable. The devolatilization zone effluent can be made to contain greater than equilibrium amounts of methane at the temperature and pressure in the zone by injecting the carbonaceous feed solids near the top of the zone thereby sweeping the methane produced by devolatilization out of the zone before it has time to back react with steam to produce carbon monoxide and hydrogen.

The process of the invention provides an integrated devolatilization and steam gasification process carried out in the presence of a carbon-alkali metal catalyst which results not only in the production of a methane-containing product gas, but also high quality hydrocarbon liquids which could not otherwise be obtained by simply gasifying the carbonaceous feed material with steam in the presence of a carbon-alkali metal catalyst.

BRIEF DESCRIPTION OF THE DRAWING

The drawing is a schematic flow diagram of an integrated catalytic devolatilization and steam gasification process carried out in accordance with the invention.

DESCRIPTION OF THE PREFERRED EMBODIMENTS

The process depicted in the drawing is one for the simultaneous production of methane and hydrocarbon liquids by the devolatilization of bituminous coal, subbituminous coal, lignite, coal char, coke, liquefaction bottoms, oil shale, or similar carbonaceous solids in the presence of a carbon-alkali metal catalyst prepared by impregnating the feed solids with a solution of an alkali metal compound, a mixture of such compounds, or a mixture of an alkali metal compound and some other metal compound, and thereafter heating the impregnated material to a temperature sufficient to produce an interaction between the alkali metal and the carbon present. The char produced by devolatilization is then gasified with steam in the presence of a carbon-alkali metal catalyst and the resultant effluent gases are treated for the recovery of a high Btu product gas consisting essentially of methane. The solid feed material that has been crushed to a particle size of about 8 mesh or smaller on the U.S. Sieve Series scale is passed into line 10 from a feed preparation plant or storage facility that is not shown in the drawing. The solids introduced into line 10 are fed into a hopper or similar vessel 11 from which they are passed through line 12 into feed preparation zone 14. This zone contains a screw conveyor or similar device, not shown in the drawing, that is powered by motor 16, a series of spray nozzles or similar devices 17, for the spraying of an alkali metal-containing solution supplied through line 18 onto the solids as they are moved through the preparation zone by the conveyor, and a similar set of nozzles or the like 19 for the introduction of a hot dry gas, such as flue gas, into the preparation zone. The hot gas, supplied through line 20, serves to heat the impregnated solids and drive off the moisture. A mixture of water vapor and gases is withdrawn from zone 14 through line 21 and passed to a condenser, not shown, from which water may be recovered for use as makeup or the like. The majority of the alkali metal-containing solution is recycled through line 69 from the alkali metal recovery portion of the process, which is described hereafter. Any makeup alkali metal solution required may be introduced into line 18 via line 13.

It is preferred that sufficient alkali metal-containing solution be introduced into preparation zone 14 to provide from about 1 to about 50 weight percent of an alkali metal compound, a mixture of such compounds or a mixture of an alkali metal compound and another metal compound on the coal or carbonaceous solids. From about 5 to about 30 weight percent is generally adequate. The dried impregnated solid particles prepared in zone 14 are withdrawn through line 24 and passed to a closed hopper or similar vessel 25 from which they are discharged through a star wheel feeder or equivalent device 26 in line 27 at an elevated pressure sufficient to permit their entrainment into a stream of high pressure steam, inert gas, or other carrier gas introduced into line 29 via line 28. The carrier gas and entrained solids are passed through line 29 into manifold 30 and fed from the manifold through feed lines 31 and nozzles, not shown in the drawing, into devolatilizer 32. In lieu of or in addition to hopper 25 and star wheel feeder 26, the feed system may employ parallel lock hoppers, pressurized hoppers, aerated standpipes operated in series, or other apparatus to raise the input feed solid stream to the required pressure level.

Devolatilizer 32 contains a fluidized bed of carbonaceous solids extending upward within the vessel above an internal grid or similar distribution device not shown in the drawing. The bed is maintained in the fluidized state by means of steam, hydrogen, carbon monoxide and carbon dioxide introduced into the bottom of the devolatilizer through bottom inlet line 33. These gases may be introduced into the devolatilizer through multiple nozzles to obtain a uniform distribution of the injected fluid and reduce the possibility of channeling and related problems. The space velocity of the rising gases within the fluidized bed will normally be between about 100 and about 1000 actual volumes of steam, hydrogen, carbon dioxide and carbon monoxide per hour per volume of fluidized solids. It is generally preferred to operate the fluidized bed devolatilizer at a pressure between about 100 and about 1000 psig, the most preferred range of operation being between about 300 and about 700 psig.

Within the fluidized bed in devolatilizer 32, the carbonaceous solids impregnated with the alkali metal compound or compounds in the alkali metal-containing solution introduced into feed preparation zone 14 are subjected to a temperature within the range between about 800° F. and about 1100° F., preferably between about 900° F. and about 1050° C. At such a temperature the alkali metal constituents interact with the carbon in the carbonaceous solids to form a carbon-alkali metal catalyst and the carbonaceous solids simultaneously undergo devolatilization whereby methane, ethane, and other gaseous constituents are driven off the solids, and lower molecular weight compounds that are normally liquids at ambient conditions are vaporized. In the presence of the carbon-alkali metal catalyst, the carbon monoxide and hydrogen in the fluidizing gases injected into the devolatilizer through bottom inlet line 33 react exothermically to form methane. The liberated exothermic heat together with the sensible heat in the fluidizing gases serve to supply the heat required to effect devolatilization of the carbonaceous feed solids. Devolatilization in the presence of the carbon-alkali metal catalyst produces light liquids substantially free of tars and having a higher Btu content and a lower oxygen content than liquids obtained from conventional devolatilization processes.

The char produced during the devolatilization in vessel 32 contains carbon-alkali metal catalyst and is withdrawn from the fluidized bed through transfer line 34, passed through a slide valve, not shown in the drawing, and injected into a fluidized bed of carbonaceous solids extending upward within gasifier 35 above an internal grid or similar distribution device not shown in the drawing. The char solids are maintained in a fluidized state within the gasifier by means of steam, carbon monoxide and hydrogen injected into the gasifier through bottom inlet line 90. The gasifier is normally operated at a pressure between about 1.0 psi and about 25 psi below the pressure in devolatilizer 32, thereby creating the driving force which forces the char produced in the devolatilizer through transfer line 34 into the gasifier. Normally, the gasifier pressure will range between about 100 psig and about 1000 psig, preferably between about 300 psig and about 700 psig. The temperature in the gasifier is normally maintained at least about 150° F. above the temperature in the devolatilizer and will preferably range between about 200° F. and about 400° F. above the devolatilizer temperature. Normally, the gasifier temperature will range between about 1100° F. and about 1500° F., preferably between about 1200° F. and about 1400° F. The space velocity of the rising gases within the fluidized bed will normally be between about 15 and about 300 actual volumes of steam, hydrogen, and carbon monoxide per hour per volume of fluidized solids.

Under the conditions in gasifier 32, the steam injected reacts with carbon in the char to produce methane, hydrogen, carbon dioxide and carbon monoxide. By carrying out the gasification process in the presence of a carbon-alkali metal catalyst, the gas phase reactions occurring during gasification are equilibrated thereby producing additional methane and at the same time supplying substantial amounts of additional exothermic heat in situ. Due to the gas phase equilibrium conditions existing as a result of the carbon-alkali metal catalyst and due to the presence of equilibrium quantities of hydrogen and carbon monoxide injected with steam near the lower end of the bed, the reaction products will normally consist essentially of methane and carbon dioxide. Competing reactions that in the absence of the catalyst and the hydrogen and carbon monoxide would ordinarily tend to produce additional hydrogen and carbon monoxide are suppressed. At the same time, substantial quantities of exothermic heat are released as a result of the reaction of hydrogen with carbon oxides and the reaction of carbon monoxide with steam. This exothermic heat tends to balance the endothermic heat consumed by the reaction of steam with carbon, thereby producing a thermoneutral reaction. So far as the heat of reaction is concerned, the gasifier is largely in heat balance. The heat employed to preheat the feed char to the reaction temperature and to compensate for heat losses from the gasifier is supplied for the most part by excess heat in the gases introduced into the gasifier through line 90. In the absence of the exothermic heat provided by the catalyzed gas phase reactions, these gases would have to be heated to substantially higher temperatures than those employed here.

The carbon-alkali metal catalyst utilized in the process of the invention is prepared by impregnating the carbonaceous feed solids with an alkali metal-containing solution and then subjecting the impregnated solids to a temperature above 800° F. in the devolatilizer. The carbon-alkali metal catalyst is then transferred along with the char produced in the devolatilizer into the gasifier. It will be understood that the carbon-alkali metal catalyst utilized in the process of this invention can be prepared without impregnation onto the carbonaceous solids to be devolatilized and then gasified, and without heating in the devolatilizer or gasifier. The heating step, for example, may be carried out in a solid feed preparation zone or in an external heater. The carbonaceous solids used will in most instances be the ones that are to be devolatilized and then gasified but in some variations of the process carbonaceous materials other than the feed solids may be used. In some cases inert carriers having carbon deposited on their outer surface may be used. Suitable inert carriers include silica, alumina, silica-alumina, zeolites and the like. The catalyst particles, whether composed substantially of carbon and an alkali metal constituent or made up of carbon and an alkali metal constituent deposited on an inert carrier, may range from fine powders to coarse lumps, particles between about 4 and about 100 mesh on the U.S. Sieve Series Scale generally being preferred.

Any of a variety of alkali metal constituents can be used in preparing the carbon-alkali metal catalyst. Suitable constituents include the alkali metals themselves and alkali metal compounds such as alkali metal carbonates, bicarbonates, formates, oxylates, hydroxides, acetates, sulfides, nitrates, and mixtures of these and other similar compounds. All of these are not equally effective and hence a catalyst prepared from certain alkali metal constituents can be expected to give somewhat better results under certain conditions than do others. In general, cesium, potassium, sodium, and lithium salts derived from organic or inorganic acids having ionization constants less than about $1\times1^{-3}$ and alkali metal hydroxides are preferred. The cesium compounds are the most effective followed by the potassium, sodium and lithium compounds in that order. Because of their high activity, relatively low cost compared to cesium compounds, and ready availability, potassium compounds or sodium compounds are generally employed. Potassium carbonate and potassium hydroxide are especially effective.

In the embodiment of the invention shown in the drawing, the alkali metal constituent or constituents and the carbonaceous solids are combined to form an intimate mixture by dissolving a water-soluble alkali metal compound, a mixture of such compounds, or a mixture of an alkali metal compound and another metal compound in an aqueous carrier, impregnating the carbonaceous solids with the resulting aqueous solution by soaking or spraying the solution onto the particles and thereafter drying the solids. It will be understood that other methods of forming such an intimate mixture may be used. For example, in some cases the carbonaceous material may be impregnated by suspending a finely divided alkali metal or alkali metal compound in a hydrocarbon solvent or other inet liquid carrier of suitably low viscosity and high volatility and thereafter treating the solids with the liquid containing the alkali metal constituent. In other cases it may be advantageous to pelletize a very finely divided alkali metal or alkali metal compound with carbon in an oil or similar binder and then heat the pellets to an elevated temperature. Other catalyst preparation methods, including simply mixing finely divided carbonaceous material with a powdered alkali metal salt and thereafter heating the mixture to the desired temperature, can in some cases be used.

The mechanisms which take place as a result of combining the carbonaceous solids and the alkali metal constituent and then heating them to elevated temperatures are not fully understood. Apparently, the alkali metal reacts with the carbon to form carbon-alkali metal compounds and complexes. Studies have shown that neither carbonaceous solids nor the alkali metal constituents alone are fully effective for establishing equilibrium conditions for gas phase reactions involving steam, hydrogen, carbon monoxide, carbon dioxide, and methane, and that catalytic activity is obtained only when a compound or a complex of the carbon and alkali metal is present in the system. Both constituents of the catalyst are therefore necessary. Experience has shown that these catalysts are resistant to degradation in the presence of sulfur compounds, that they resist sintering at high temperatures, and that they bring gas phase reactions involving gases normally produced during coal gasification and devolatilization into equilibrium. As a result of these and other beneficial properties, these catalysts have pronounced advantages over other catalysts employed in the past.

Referring again to the drawing, the gas leaving the fluidized bed in gasifier 35 passes through the upper section of the gasifier, which serves as a disengagement zone where particles too heavy to be entrained by the gas leaving the vessel are returned to the bed. If desired this disengagement zone may include one or more cyclone separators or the like for the removal of relatively large particles from the gas. The gas withdrawn from the upper part of the gasifier through line 36 will normally contain an equilibrium mixture at reaction temperature and pressure of methane, carbon dioxide, hydrogen, carbon monoxide, and unreacted steam. Also present in this gas are hydrogen sulfide, ammonia and other contaminants formed from the sulfur and nitrogen contained in the char fed to the gasifier and entrained fines. This raw product gas, which will normally contain between about 15 and about 25 mole percent methane, is introduced into cyclone separator or similar device 37 where the fine particulates are removed. The gas from which the solids have been separated is withdrawn overhead from separator 37 and no portion of it is passed into devolatilizer 32. Instead, the gas is passed downstream for further processing as described in detail hereafter. The fine particles removed from the gas in separator 37 are discharged downward through dip leg 38 and may be returned to the gasifier or passed to the alkali metal recovery portion of the process.

The gas leaving the fluidized bed in devolatilizer 32 is withdrawn from the upper part of the devolatilizer through line 39 and will normally contain vaporous constituents produced by the devolatilization of the carbonaceous feed material and gaseous constituents including methane, carbon monoxide, hydrogen, ethane, propane, and unreacted steam. Hydrogen sulfide, ammonia, and other contaminants formed from the sulfur and nitrogen compounds in the feed material and fine particulates will also be present in the devolatilizer effluent gas. The effluent gas may also contain entrained liquids produced during the devolatilization process that takes place in vessel 32. This raw product gas, which will normally contain between about 25 mole percent and about 50 mole percent methane, is introduced into cyclone separator or similar device 40 where the particulates are removed. The gaseous and vaporous constituents from which the solids have been separated are taken overhead from separator 40 through line 41 and the particulates are discharged downward through dip leg 42 and normally passed to the bottom of the fluidized bed in gasifier 35.

The effluent gas withdrawn overhead from separator 40 is passed through line 41 into the bottom of hot oil scrubber or similar device 43. Here the gas passes upward through the contacting zone in the scrubber where it comes in direct contact with a downflowing stream of cool oil introduced into the top of the scrubber through line 44. As the gas rises through the contacting zone, heat from its vaporous constituents is absorbed by the cool oil thereby causing the vapors to condense forming liquid hydrocarbons which are withdrawn from the bottom of the scrubber through line 45. A portion of these hydrocarbon liquids is recycled through heat exchanger 46 where they are cooled to produce the low temperature oil introduced into the top of the hot oil scrubber through line 44. The remainder of the liquids are withdrawn through line 47 as hydrocarbon liquid product. It has been found that these liquids, which are produced by devolatilization in the presence of a carbon-alkali metal catalyst, are substantially free of tars, have a low oxygen content, a high Btu content, a high stability and are generally higher quality liquids than can ordinarily be obtained by conventional devolatilization processes carried out in the absence of a catalyst. These high quality liquids are suitable for use as fuel, solvents, refinery and petrochemical feedstocks, and other similar uses.

The devolatilizer effluent gas from which the vaporous constituents have been condensed is withdrawn overhead from hot oil scrubber 43 through line 48 and passed to water scrubber 49. Here the gas stream passes upward through the scrubber where it comes in contact with water injected into the top of the scrubber through line 50. The water absorbs ammonia and a portion of the hydrogen sulfide in the gas stream and at the same time serves to further cool the gas and thereby condense out the unreacted steam. The sour water thus produced is withdrawn from the bottom of the scrubber through line 51 and passed to downstream units for further processing. The water-scrubbed gas stream is withdrawn from the scrubber through line 52 and is now ready for treatment to remove bulk amounts of hydrogen sulfide and other acid gases.

The gas stream is passed from water scrubber 49 through line 52 into the bottom of solvent scrubber 53. Here the gas passes upward through the contacting zone in the scrubber where it comes in contact with a downflowing stream of solvent such as monoethanolamine, diethanolamine, a solution of sodium salts of amino acids, methanol, hot potassium carbonate or the like introduced into the upper part of the solvent scrubber through line 54. If desired, the solvent scrubber may be provided with spray nozzles, perforated plates, bubble plates, packing or other means for promoting intimate contact between the gas and the solvent. As the gas rises through the contacting zone, hydrogen sulfide, carbon dioxide and other acid gases are absorbed by the solvent which exits the scrubber through line 55. The spent solvent containing carbon dioxide, hydrogen sulfide and other contaminants is passed through line 55 to a stripper or regenerator, not shown in the drawing, to remove the absorbed contaminants and thereby regenerate the solvent. The regenerated solvent may then be reused by injecting it back into the top of the scrubber via line 54.

A methane-rich gas, which will also contain some hydrogen, carbon monoxide, ethane and propane, is withdrawn overhead from the solvent scrubber via line 56. The methane content of the gas will normally range between about 50 and about 90 mole percent. A portion of this methane-rich gas is passed through line 57 and combined with part of the gasifier effluent gas as described in detail hereafter. The portion of this methane-rich gas that is not passed through line 57 is passed through line 58 to compressor 59 where its pressure is increased to a value from about 25 psi to about 75 psi above the operating pressure in devolatilizer 32. The pressurized gas is withdrawn from compressor 59 through line 60 and mixed with steam injected into line 60 through line 61. The resultant mixture is then introduced into the internal tubes 62 of steam reforming furnace 63 where the methane-rich gas and the steam react with one another in the presence of a conventional steam reforming catalyst. The catalyst will normally consist of metallic constituents supported on an inert carrier. The metallic constituent will normally be selected from Group VI-B in the iron group of the Periodic Table and may be chromium, molybdenum, tungsten, nickel, iron and cobalt and may include small amounts of potassium carbonate or a similar compound as a promoter. Suitable inert carriers include silica, alumina, silica-alumina, zeolites, and the like.

The reforming furnace is operated under conditions such that methane in the methane-rich gas will react with steam in the tubes 62 to produce hydrogen and carbon monoxide according to the following equation: $H_2O+CH_4 \rightarrow 3H_2+CO$. The temperature in the reforming furnace will normally be maintained between about 1200° F. and about 1500° F., preferably between about 150° F. and about 400° F. above the temperature in devolatilizer 32. The pressure in the furnace will range between about 10 and about 30 psi above the pressure in the devolatilizer. The ratio of steam to methane-rich gas introduced into the reformer will range between about 2.0 and about 4.0 or higher but will preferably range between about 2.5 and about 3.5. The reforming furnace is preferably fired by a portion of the methane-rich gas removed from line 56 through line 57. The required amount of gas is withdrawn from line 57 and passed directly to the fire box in the steam reforming furnace.

The gaseous effluent stream from the steam reforming furnace 63 will normally comprise a mixture of carbon dioxide formed by the water-gas shift reaction, hydrogen, carbon monoxide and unreacted steam, and will normally be substantially free of methane. All of the methane in the gas fed to the furnace will normally react with steam in the furnace to produce hydrogen and carbon monoxide. The gaseous effluent stream is passed from the reforming furnace, preferably without substantial cooling, through lines 64 and 33 into devolatilizer 32. This stream is normally the only source of the hydrogen and carbon monoxide which react exothermically in the devolatilizer in the presence of the carbon-alkali metal catalyst at a relatively low temperature to provide the heat required to preheat and devolatilize the carbonaceous feed solids. The amount of methane-rich gas passed through line 58, compressor 59 and line 60 to steam reforming furnace 63 is primarily determined by the amount of methane which must be formed in the devolatilizer to supply the exothermic heat, which is required in addition to the sensible heat in the steam reforming furnace effluent to effect devolatilization of the carbonaceous feed solids. Normally, substantially all of the heat requirements of the devolatilizer are supplied by the sensible heat in the reforming furnace effluent along with the amount of carbon monoxide and hydrogen which is available to exothermically form methane in the devolatilizer. Thus, the need to inject oxygen into the devolatilizer to burn a portion of the carbon is obviated.

The integration of the devolatilizer with the gasifier and the carrying out of both devolatilization and gasification in the presence of a carbon-alkali metal catalyst as described above has been found to have many advantages. Since the devolatilizer is operated at a temperature substantially lower than the gasification temperature, thermodynamics favor the formation of large amounts of methane by the exothermic reaction of hydrogen and carbon monoxide as follows: $3H_2+CO \rightarrow CH_4+H_2O$. This reaction is highly exothermic and releases a substantial portion of the heat required to effect devolatilization. The presence of a carbon-alkali metal catalyst allows this reaction to occur at a reasonable reaction rate at the low devolatilization temperature. By injecting the carbonaceous feed solids at a position relatively high in the fluidized bed devolatilizer, methane produced by devolatilization, rather than by the reaction of hydrogen with carbon monoxide, will be carried out of the devolatilizer before it can back react with steam to form hydrogen and carbon monoxide and the devolatilizer effluent will therefore contain greater than equilibrium amounts of methane at the temperature and pressure in the devolatilizer. Furthermore, injection of the solids at a point near the top of the devolatilizer will result in a large production of high quality liquids.

It will be understood that although the devolatilizer is described as a fluid bed reactor it may consist of an entrained flow transfer line, a free fall zone, a fixed bed reactor or the like. The devolatilizer is normally operated at a temperature as low as possible to obtain substantial devolatilization of the carbonaceous feed solids while at the same time maintaining a reasonable rate for the reaction of carbon monoxide with hydrogen to form methane. Normally, the temperature in the devolatilizer will be sufficiently lower than the gasifier temperature to prevent any substantial reaction of steam with the carbon in the solids fed to the devolatilizer.

The use of a steam reforming zone to convert methane produced in the devolatilizer into carbon monoxide and hydrogen which is then utilized as the gaseous feed to the devolatilizer thereby obviating the need to pass any of the gasifier effluent gases into the devolatilizer also provides many advantages. The vaporized liquids produced by devolatilization will not be diluted by the large volume of gasifier effluent gases and will therefore be present at a high concentration in the devolatilizer effluent. This results in the need for a minimum sized hot oil scrubber to efficiently recover liquid product. Also, since the devolatilizer effluent is not diluted by the gasifier effluent, the methane content of the stream recycled through the reforming zone is relatively high, thus minimizing the size of the gas stream passed to the reforming zone. This, in turn, results in a smaller reformer and a smaller gas stream from which sulfur must be removed to meet stringent reformer feed specifications. The reformer outlet temperature provides a very sensitive temperature control of the devolatilization taking place in the devolatilizer since the heating value of the reformer effluent gas is increased both by the sensible heat of the gas as well as the amount of hydrogen and carbon monoxide present which reacts in the devolatilizer to form methane and liberate heat. Furthermore, the gasifier can be operated independently of the devolatilizer by feeding the carbonaceous solids directly to the gasifier. This would allow maintenance operations to be carried out on the devolatilizer while the gasifier was still operating. The separate processing of both the gasifier effluent and devolatilizer effluent streams permits independent control of the operating conditions in both reactors.

Referring again to the drawing, a stream of high ash content char particles is withdrawn through line 65 from gasifier 35 in order to control the ash content of the system and permit the recovery and recycle of alkali metal constituents of the catalyst. The solids in line 65, which may be combined with fines recovered from the gasifier overhead gas through dip leg 38, are passed to alkali metal recovery unit 66. The recovery unit will normally comprise a multistage countercurrent leaching system in which the high ash content particles containing alkali metal constituents are countercurrently contacted with water introduced through line 67. The first stage of the catalyst recovery unit may utilize calcium hydroxide digestion to convert water-insoluble catalyst constituents into water-soluble constituents. Such a digestion step is described in detail in U.S. Pat. No. 4,159,195, the disclosure of which is hereby incorporated by reference. An aqueous solution of alkali metal compounds is withdrawn from the unit through line 68 and recycled through lines 69 and 18 to feed preparation zone 14. Ash residues from which soluble alkali metal compounds have been leached are withdrawn from the recovery unit through line 70 and may be disposed of as landfill.

As previously mentioned, the effluent from gasifier 35 is passed through separator 37 to remove entrained fines and the gas withdrawn overhead from the separator will contain an equilbrium mixture of hydrogen, carbon monoxide, carbon dioxide, methane, and unreacted steam along with hydrogen sulfide, ammonia and other contaminants. This gas is passed through line 71 into water scrubber 72 where the gas is passed upward through the scrubber and contacted with water injected into the top of the scrubber through line 73. The water absorbs ammonia and a portion of the hydrogen sulfide in the gas stream and at the same time serves to cool the gas, thereby causing the unreacted steam to condense. The sour water thus produced is withdrawn from the bottom of the scrubber through line 74 and passed to downstream units for further processing. The water-scrubbed gas stream is withdrawn from the scrubber through line 75 and is now ready for treatment to remove bulk amounts of hydrogen sulfide and other acid gases.

The gas stream is passed from water scrubber 72 through line 75 into the bottom of solvent scrubber 76. Here the gas passes upward through the contacting zone in the scrubber where it comes in contact with a downflowing stream of solvent such as monoethanolamine, diethanolamine, a solution of sodium salts of amino acids, methanol, hot potassium carbonate or the like introduced into the upper part of the solvent scrubber through line 77. As the gas rises through the contacting zone, hydrogen sulfide, carbon dioxide, and other acid gases are absorbed by the solvent, which exits the scrubber through line 78. The spent solvent containing carbon dioxide, hydrogen sulfide, and other contaminants is passed through line 78 to a stripper or regenerator, not shown in the drawing, to remove the absorbed contaminants and thereby regenerate the solvent. The regenerated solvent may then be reused by injecting it back into the top of the scrubber via line 77.

A clean gas containing essentially methane, hydrogen, and carbon monoxide is withdrawn overhead from solvent scrubber 76 through line 79. The methane content of the gas will normally range between about 35 and about 45 mole percent and the gas will be of an intermediate Btu heating value, normally containing between about 400 and about 700 Btu's per standard cubic foot. This intermediate Btu gas is then mixed with the methane-rich gas produced by treating the devolatilizer effluent gas as previously described and injected into line 79 via line 57. This methane-rich gas will consist primarily of methane but will also contain some carbon monoxide, hydrogen and small amounts of low molecular weight hydrocarbon gases. The combined gas stream is then introduced into heat transfer unit 80 where it passes in indirect heat exchange with liquid methane introduced through line 81. The methane vaporizes within the heat transfer unit and is discharged as methane product gas through line 82. The vaporizing methane chills the combined gas stream which is composed primarily of methane, hydrogen, and carbon monoxide, to a low temperature approaching that required for liquefaction of the methane contained in the gas, after which the chilled gas is passed through line 83 into cryogenic unit 84. Here the gas is further cooled by conventional means until the temperature reaches a value sufficiently low to liquefy the methane under the pressure conditions existing in the unit. Compressors and other auxilliaries associated with the cryogenic unit are not shown. The amount of pressure required for the liquefaction step will depend in part upon the pressure at which gasifier 35 is operated and the pressure losses which are incurred in the various portions of the system. A substantially pure stream of liquefied methane is taken off through line 81 and passed into heat transfer unit 80 as described earlier. Hydrogen and carbon monoxide are withdrawn overhead from cryogenic unit 84 through line 85. Normally the cryogenic unit is operated and designed in such a manner that less than about 10 mole percent methane, preferably less than about 5 mole percent, remains in the hydrogen and carbon monoxide stream removed through line 85.

The gas stream removed from cryogenic unit 84 is passed through line 85 to compressor 86 where its pressure is increased to a value from about 25 psi to about 75 psi above the operating pressure in gasifier 35. The pressurized gas is withdrawn from compressor 86 and passed through line 87 to preheat furnace or similar device 88 where the gas is preheated. The preheated gas is removed from furnace 88, passed through line 89 and mixed with steam in line 90. The resultant mixture, which consists primarily of steam, carbon monoxide and hydrogen, is then injected into gasifier 35. This stream is the source of the hydrogen, carbon monoxide and steam required in the gasifier in addition to the carbon-alkali metal catalyst to produce the thermoneutral reaction that results in the formation of essentially carbon dioxide and methane.

In the embodiment of the invention shown in the drawing and described above, the intermediate Btu gas, which consists primarily of methane, carbon monoxide and hydrogen, formed by mixing the gas withdrawn from solvent scrubber 76 through line 79 with the methane-rich gas in line 57 is cryogenically separated into a stream consisting essentially of methane and a stream consisting primarily of carbon monoxide and hydrogen. The methane is recovered as the methane-containing product gas of the process and the carbon monoxide and hydrogen are recycled to the gasifier to provide the required added hydrogen and carbon monoxide. It will be understood that the process of the invention is not limited to this particular embodiment but also encompasses the case where the combined stream of methane, carbon monoxide and hydrogen is not subjected to cryogenic separation or any other separation process and is instead recovered directly as a methane-containing product gas of an intermediate Btu heating value. Such a product gas may be used as a fuel to supply the heat requirements of other industrial plants or for other purposes. If this is done, the hydrogen and carbon monoxide required in the gasifier is supplied by passing a portion of the effluent from steam reforming furnace 63, which is withdrawn from the furnace through line 64, into the gasifier. In this latter embodiment of the invention, the amount of gas fed to steam reforming furnace through line 58, compressor 59, and line 60 will normally be increased a sufficient amount to allow the effluent from the reforming furnace to contain not only the quantities of hydrogen and carbon monoxide required in devolatilizer 32 but also the quantities required in gasifier 35. If necessary, a portion of the intermediate Btu product gas can also be used as a portion of the feed to the steam reforming furnace 63.

It will be apparent from the foregoing that the invention provides an integrated coal devolatilization and steam gasification process in which both the devolatilization and gasification steps are carried out in the presence of a carbon-alkali metal catalyst to simultaneously produce high-quality hydrocarbon liquids and a methane-containing gas.

We claim:

1. An integrated catalytic devolatilization and steam gasification process for the simultaneous production of hydrocarbon liquids and a methane-containing gas from carbonaceous feed solids which comprises:

(a) introducing said carbonaceous feed solids into a devolatilization zone;

(b) introducing a mixture of gases containing carbon monoxide and hydrogen into said devolatilization zone;

(c) contacting said carbonaceous feed solids in said devolatilization zone with said mixture of gases in the presence of a carbon-alkali metal catalyst at a temperature sufficiently high to devolatilize said carbonaceous feed solids but sufficiently low to prevent any substantial reaction of steam with said carbonaceous solids thereby producing char and a devolatilization effluent containing gaseous and vaporous constituents, wherein said carbon-alkali metal catalyst serves to catalyze the exothermic reaction of the carbon monoxide and hydrogen in said mixture of gases to form methane and wherein said temperature is sufficiently low that equilibrium in said devolatilization zone favors the formation of methane by said reaction of carbon monoxide and hydrogen and said reaction occurs to such an extent that substantially all of the heat required in said devolatilization zone is supplied by the heat given off by said reaction and by the sensible heat in the mixture of gases introduced into said devolatilization zone;

(d) treating said devolatilization zone effluent to recover substantially tar free hydrocarbon liquids as product and a methane-rich gas;

(e) contacting at least a portion of said methane-rich gas with steam in a steam reforming zone under conditions such that at least a portion of the methane in said methane-rich gas reacts with steam to produce hydrogen and carbon monoxide;

(f) using the effluent from said steam reforming zone as the mixture of gases introduced into said devolatilization zone in step (b);

(g) passing said char produced in said devolatilization zone into a steam gasification zone;

(h) reacting said char with steam in said steam gasification zone under gasification conditions in the presence of a carbon-alkali metal catalyst and sufficient added hydrogen and carbon monoxide to provide substantially equilibrium quantities of hydrogen and carbon monoxide in said steam gasification zone at the gasification temperature and pressure;

(i) withdrawing from said steam gasification zone a raw product gas containing substantially equilibrium quantities, at the gasification temperature and pressure, of methane, carbon dioxide, steam, hydrogen, and carbon monoxide, wherein substantially none of said raw product gas is passed into said devolatilization zone; and (j) recovering a methane-containing gas as product from said withdrawn raw product gas.

2. A process as defined by claim 1 wherein said carbonaceous feed solids comprise coal.

3. A process as defined by claim 2 wherein said carbon-alkali metal catalyst is prepared by treating said coal with an alkali metal compound and thereafter heating the treated coal to the temperature in said devolatilization zone.

4. A process as defined by claim 2 wherein said coal is impregnated with an aqueous solution of an alkali metal compound and dried prior to the introduction of said coal into said devolatilization zone.

5. A process as defined by claim 4 wherein said aqueous solution contains alkali metal compounds recovered from char withdrawn from said steam gasification zone.

6. A process as defined by claim 1 wherein the temperature in said devolatilization zone is maintained in the range between about 800° F. and about 1100° F.

7. A process as defined by claim 1 wherein the raw product gas withdrawn from said steam gasification zone is treated for the removal of carbon dioxide, methane is recovered from the treated gas as said methane-containing gas, and hydrogen and carbon monoxide contained in said treated gas are recycled to said steam gasification zone as said added hydrogen and carbon monoxide.

8. A process as defined by claim 1 wherein said raw product gas withdrawn from said steam gasification zone is treated for the removal of carbon dioxide, an intermediate Btu gas comprising a mixture of methane, carbon monoxide and hydrogen is recovered from said treated gas as said methane-containing gas, and a sufficient amount of said methane-rich gas stream recovered from said devolatilization zone effluent is reacted with steam in said steam reforming zone to produce enough additional hydrogen and carbon monoxide to supply said added hydrogen and carbon monoxide required in said steam gasification zone.

9. A process as defined by claim 8 wherein the portion of said methane-rich gas recovered from said devolatilization zone effluent that is not contacted with steam in said steam reforming zone is combined with said intermediate Btu gas and the resultant mixture is recovered as said methane-containing product gas.

10. A process as defined in claim 1 wherein the raw product gas withdrawn from said steam gasification zone is treated for the removal of carbon dioxide and combined with the portion of said methane-rich gas recovered from said devolatilization zone effluent that is not contacted with steam in said steam reforming zone, methane is recovered from the combined gas stream as said methane-containing product gas and hydrogen and carbon monoxide contained in said combined gas stream are recycled to said steam gasification zone as said added hydrogen and carbon monoxide.

11. A process as defined by claim 1 wherein said devolatilization zone comprises a fluidized bed reaction zone.

* * * * *